US009633802B2

(12) United States Patent
Chapelle et al.

(10) Patent No.: US 9,633,802 B2
(45) Date of Patent: Apr. 25, 2017

(54) VACUUM BULB, CIRCUIT-BREAKER POLE INCLUDING SUCH A VACUUM BULB, AND METHOD TO MANUFACTURE SUCH DEVICES

(71) Applicant: SCHNEIDER ELECTRIC INDUSTRIES SAS, Rueil Malmaison (FR)

(72) Inventors: Delphine Chapelle, Lamastre (FR); Mehrdad Hassanzadeh, Clapiers (FR)

(73) Assignee: SCHNEIDER ELECTRIC INDUSTRIES SAS, Rueil-Malmaison (FR)

( * ) Notice: Subject to any disclaimer, the term of this patent is extended or adjusted under 35 U.S.C. 154(b) by 0 days.

(21) Appl. No.: 14/449,334

(22) Filed: Aug. 1, 2014

(65) Prior Publication Data

US 2015/0041437 A1 Feb. 12, 2015

(30) Foreign Application Priority Data

Aug. 9, 2013 (FR) ..... 13 57942

(51) Int. Cl.
*H01H 9/34* (2006.01)
*H01H 11/04* (2006.01)
*H01H 33/662* (2006.01)

(52) U.S. Cl.
CPC ..... *H01H 9/346* (2013.01); *H01H 11/04* (2013.01); *H01H 33/66207* (2013.01);
(Continued)

(58) Field of Classification Search
CPC ..... H01H 33/662; H01H 33/66207; H01H 33/53; H01H 33/022; H01H 33/72;
(Continued)

(56) References Cited

U.S. PATENT DOCUMENTS 5,750,581 A 5/1998 Brennenstuhl et al.
5,808,258 A * 9/1998 Luzzi ..... H01H 33/66207 218/136

(Continued)

FOREIGN PATENT DOCUMENTS

EP 0 866 481 A2 9/1998
EP 0 971 369 A1 1/2000

(Continued)

OTHER PUBLICATIONS

French Preliminary Search Report issued May 8, 2014 in French Application 13 57942, filed on Aug. 9, 2013 ( with English Translation of Categories of Cited Documents).

(Continued)

*Primary Examiner* — Renee Luebke
*Assistant Examiner* — William Bolton
(74) *Attorney, Agent, or Firm* — Oblon, McClelland, Maier & Neustadt, L.L.P.

(57) ABSTRACT

A vacuum bulb is provided, including a sealed chamber; two electrical contacts, which move relative to one another, the chamber including a cylindrical body of a dielectric material and closed at ends thereof by two metal covers, each of the two metal covers being connected to one of the two electrical contacts: and a dielectric coating, which covers an outer surface of the chamber, and includes at least two layers, including an overmolding layer of a synthetic material and an intermediate layer of silicone, the intermediate layer being interposed between the outer surface and the overmolding layer, the intermediate layer being discontinuous and localized on metal portions of the chamber so as to cover at least partially an outer surface of the metal portions, and the silicone includes compressible hollow bodies having a skin of a thermoplastic material.

18 Claims, 2 Drawing Sheets

(52) U.S. Cl.
CPC ..... *H01H 2033/6623* (2013.01); *H01H 2033/66269* (2013.01); *Y10T 29/49105* (2015.01)

(58) Field of Classification Search
CPC .. H01H 33/64; H01H 2033/6623; H01H 9/02; H01H 9/342; H01H 71/02; H01H 73/06; H01H 1/66; H01H 11/04; H01H 9/346
USPC ..... 218/134, 138, 139, 155, 152, 156, 157, 218/136; 335/201
See application file for complete search history.

(56) References Cited

U.S. PATENT DOCUMENTS 5,917,167 A 6/1999 Bestel
6,194,476 B1 * 2/2001 De Ridder ..... C08K 7/22 521/54
7,205,499 B2 4/2007 Masnada et al.
8,178,812 B2 5/2012 Martin et al.
8,227,720 B2 * 7/2012 Tsuchiya ..... H01H 33/66261 218/136
2004/0232113 A1 * 11/2004 Kynast ..... H01H 33/662 218/136
2004/0242034 A1 * 12/2004 Rinehart ..... H01H 33/662 439/100
2007/0068890 A1 * 3/2007 Rohrig ..... A61J 9/04 215/11.1
2007/0140891 A1 6/2007 Hassanzadeh et al.
2008/0142485 A1 6/2008 Gentsch et al.
2009/0134125 A1 5/2009 Inoue et al.
2010/0246102 A1 * 9/2010 Martin ..... H01H 33/66207 361/605
2010/0273631 A1 * 10/2010 Pelletier ..... C03C 3/085 501/26
2013/0126480 A1 * 5/2013 Shang ..... H01H 33/66207 218/134
2013/0213938 A1 * 8/2013 Bramhapurikar H01H 33/66207 218/136

FOREIGN PATENT DOCUMENTS

EP 1 571 685 A1 9/2005
JP 2002-358861 12/2002
WO WO 2009/106731 A2 9/2009

OTHER PUBLICATIONS

U.S. Appl. No. 11/338,521, filed Jan. 23, 2006, Hassanzadeh.

* cited by examiner

VACUUM BULB, CIRCUIT-BREAKER POLE INCLUDING SUCH A VACUUM BULB, AND METHOD TO MANUFACTURE SUCH DEVICES

TECHNICAL FIELD

The present invention relates to a vacuum bulb which is intended to be used in a switchgear.

The present invention also relates to a switchgear including at least one such vacuum bulb, where this device can be in particular a circuit-breaker pole or a switch, and where this device operates, in particular, at medium voltage.

Finally, the present invention relates to a method for manufacturing such a vacuum bulb and also to a method for manufacturing such a circuit-breaker pole.

STATE OF THE PRIOR ART

A vacuum bulb is an element of a switchgear used in equipment and facilities operating in particular at medium voltage, and in particular between 1 and 75 kV.

A vacuum bulb generally includes a sealed chamber, two electrical contacts which move relative to one another and, if applicable, at least one protective metal screen. The sealed chamber of the vacuum bulb includes a cylindrical body closed at its ends by two metal covers, where each of these covers is connected to one of the electrical contacts of the vacuum bulb.

The cylindrical body of the vacuum chamber is made of a dielectric material, previously glass, and currently made of a ceramic material, and in particular alumina, whereas the metal covers are conventionally made of copper or stainless steel.

The vacuum bulb also includes a dielectric coating which covers the outer surface of the chamber in order to be electrically insulated.

This dielectric coating can consist of a layer called an overmoulding layer, made of an electrically insulating synthetic material. The term commonly used is then an "overmoulded vacuum bulb".

This dielectric synthetic material can be an elastomer material, but also a polymer material of the thermosetting polymer or thermoplastic polymer type. Thus, when the overmoulding layer is made of thermosetting or thermoplastic polymer, it mechanically holds the vacuum bulb whilst in operation, in addition to insulating it electrically.

However, it is observed that the materials used to produce the sealed chamber of a vacuum bulb and the overmoulding layer have very different thermal expansion coefficients. Consequently, when these different materials are in contact, and when the vacuum bulb is subject to thermal stress due, for example, to the surrounding temperature or to the heating of the electrically conductive elements, and in particular of the metal covers, cracks appear in some of the materials constituting the overmoulded vacuum bulb, particularly at the interface between the metal elements of the chamber and the overmoulding layer.

To limit the formation of such cracks, it is known to interpose an intermediate layer between the outer surface of the sealed chamber and the overmoulding layer, the aim of which intermediate layer is to compensate for the thermal expansion differences of the overmoulding layer and of the elements constituting the chamber of the vacuum bulb, in particular when there are temperature variations of said vacuum bulb.

Thus, document EP 0 866 481, referenced [1] at the end of the present description, describes a vacuum bulb including a vacuum chamber covered with an overmoulding layer made of epoxide polymer and a continuous intermediate layer interposed between the outer surface of the chamber and this overmoulding layer. This intermediate layer has the form of a tube and is installed by sliding the said tube, the diameter of which is kept greater than the outer diameter of the cylindrical body, on to the outer surface of the chamber of the vacuum bulb. This intermediate layer is made of an elastic material which can be an elastomer material of the ethylene-propylene copolymer (EPM) or ethylene-propylene-diene terpolymer (EPDM) type. This elastic material can also be a silicone rubber. However, this continuous intermediate layer is not completely incorporated or covered by the overmoulding layer, to enable it to expand under the effect of rises in temperature of the vacuum bulb. Document [1] stipulates that, in the particular case in which a silicone rubber is used, this material either does not completely fill the volume available for the intermediate layer, or completely fills this volume, but it then becomes necessary to make an aperture at one end of the chamber, to allow, in both cases, an expansion of the material when it expands under the effect of the rises in temperature.

The vacuum bulb described in document [1] therefore has structural constraints which must be taken into account to allow expansion of the intermediate layer. The associated manufacturing method is made complicated by the need to include one or the other of these structural constraints, for each vacuum bulb structure considered.

In addition, if an aperture is made in the vacuum bulb chamber to allow expansion of the material, this material is then in contact with the outer environment of the vacuum bulb, and therefore subject to contamination by pollution present in this environment, such as moisture, dust or gases such as sulphur hexafluoride $SF_6$ or sulphur dioxide $SO_2$. Such contamination can cause the material of the intermediate layer to age prematurely and, in particular, can cause it to lose its dielectric properties and/or its mechanical properties (loss of resilience and adherence, notably with the overmoulding layer).

Document U.S. Pat. No. 5,917,167, referenced [2], describes a method for manufacturing a vacuum bulb including encapsulation of the chamber of the vacuum bulb by a silicone rubber sleeve forming the intermediate layer before manufacture of the epoxide polymer overmoulding layer. This process implements a step during which the sleeve is positioned in a vacuum manifold to undergo within it a radial deformation of at least twice the initial internal diameter of the said sleeve, so as to allow subsequent insertion of the chamber of the vacuum bulb in the inner space of the stretched sleeve. After pressure is re-established in the vacuum manifold the stretched silicone rubber sleeve covers this chamber of the vacuum bulb. The epoxide polymer overmoulding layer is then produced such that the stretched silicone rubber sleeve is compressed by the said overmoulding layer. Compression of the sleeve is, however, limited by the presence of an aperture made in the chamber of the vacuum bulb which allows expansion of the sleeve.

In addition to making an aperture in the chamber of the vacuum bulb to allow expansion of the intermediate silicone rubber layer, this document [2] describes a method which is relatively cumbersome, in industrial terms, due to the need to use a vacuum manifold to install this intermediate layer. In addition, this intermediate layer takes the form of a sleeve of predetermined dimensions which must, of course, be appropriate for the diameter of the chamber of the vacuum bulbs intended to receive a coating as described in this document [2]. Such constraints are consequently not compatible with rationalised production.

Furthermore, compression of the overmoulding layer on the silicone rubber sleeve does not allow a sufficiently tight interface to be produced between these two layers. This is particularly prejudicial if the dielectric coating of the vacuum bulb is itself coated with an electrically conductive layer, called a shielding layer, allowing the exterior of the vacuum bulb to be earthed.

The inventors therefore set themselves the goal of designing a vacuum bulb, in particular an overmoulded vacuum bulb, including a dielectric coating and having improved thermomechanical properties and ageing properties, thus allowing prolonged use over time of this vacuum bulb, where the risks of cracking in the overmoulding layer, but also in the vacuum bulb's cylindrical body itself, with the related risks of loss of the vacuum, were substantially reduced, or even eliminated, under the effect of thermal variations. In particular, the vacuum bulb must be able to be manufactured without any need to set a more or less arbitrary limitation of the volume of silicone to be used to produce the intermediate layer relative to the total volume which this intermediate layer could occupy, or to make an aperture in the chamber of the vacuum bulb, which constitutes a real industrial and technical constraint and which, if indeed an aperture is made, is moreover not satisfactory with regard to the risk of contamination by the external environment of the vacuum bulb, as mentioned above.

Another current solution for manufacturing a vacuum bulb includes the following successive steps:

- assembly of the cylindrical body with each of its two covers fitted with an electrical contact to form the chamber of the vacuum bulb,
- possibly, application of a layer of primer over the entire outer surface of the chamber of the vacuum bulb,
- moulding by injection of a liquid silicone rubber (LSR) to form a layer of silicone over the entire outer surface of the chamber of the vacuum bulb, if applicable coated with the primer layer,
- moulding by injection by means of a process of automatic pressure gelation (APG) of the epoxide polymer on the silicone layer.

The step of moulding by injection of a liquid silicone rubber, which requires the use of high pressures to obtain the optimum characteristics of the silicone used, can however not be implemented on all types of vacuum bulb chambers. This is the case in particular when the said chamber includes covers made from a soft metal material (of the copper type), and which have a substantial surface which is deformed during this high-pressure injection step.

The inventors also set themselves the aim of devising a method for manufacturing a vacuum bulb, in particular an overmoulded vacuum bulb, able to be used in any type of vacuum bulb, whatever its shape or dimensions, and whatever the material of some of its elements constituting the chamber and, in particular, the shape, dimensions and material of the metal covers of the said chamber.

DESCRIPTION OF THE INVENTION

The aims set out above, and others, are attained, firstly, by a vacuum bulb of the abovementioned type which includes a sealed chamber and two electrical contacts which move relative to one another, where the said chamber includes a cylindrical body made of a dielectric material and closed at its ends by two metal covers, where each of these covers is connected to one of the electrical contacts, where the said vacuum bulb also includes a dielectric coating which covers the outer surface of the chamber, where this coating includes at least two layers, the first layer called the overmoulding layer being made of a synthetic material, and a second layer called the intermediate layer being made of silicone, where the said intermediate layer is interposed between the outer surface of the chamber and the overmoulding layer.

According to the invention, the intermediate layer is discontinuous and localised on the metal portions of the chamber so as to cover at least partially the outer surface of these metal portions, in this case the outer surface of the metal covers, including notably its edge, or interface area, between the metal portions and the dielectric material of the cylindrical body, where the silicone of the intermediate layer includes hollow bodies, and where these hollow bodies are compressible and have a skin made of a thermoplastic material.

By this means the hollow bodies present in the silicone of the intermediate layer are compressed to act against the effects caused by the thermal expansion occurring in the intermediate layer, when said intermediate layer is trapped in a closed space, under the effect of rises in temperature of the elements constituting the vacuum bulb, and in particular of the intermediate layer.

Consequently it is no longer necessary to limit artificially the volume of silicone relative to the total volume which the intermediate layer could occupy, or to make an aperture, for example at one of the ends of the chamber, to allow the expansion of this intermediate layer. This has the benefit that it prevents any premature degradation of the material of the intermediate layer, since this material is not in contact with the outside environment of the vacuum bulb and any pollution it may contain, and therefore has the benefit of giving the vacuum bulb according to the invention improved thermomechanical and ageing properties.

The intermediate layer is advantageously localised on the metal portions of the chamber so as to cover at least the entire outer surface of the elements protruding from these metal portions.

This intermediate layer is preferentially localised on these metal portions so as to cover at least the entire outer surface of the said metal portions.

The localisation of the intermediate layer such that it covers at least the entire outer surface of the elements protruding from the metal portions, or the entire outer surface of these metal portions of the sealed chamber of the vacuum bulb, thus has the effect that these metal portions are no longer entirely in direct contact with the overmoulding layer. These localisations of the intermediate layer consequently limit or prevent the formation of cracks in this overmoulding layer when temperature variations are occurring in the vacuum bulb.

While the expansion of the intermediate layer causes a thermomechanical stress on the overmoulding layer and on the cylindrical body of the chamber of the vacuum bulbs of the prior art, the hollow bodies present in the silicone of the intermediate layer absorb this expansion and, consequently, this thermomechanical stress, consequently limiting its effect on the overmoulding layer and on the cylindrical body of a vacuum bulb in accordance with the invention.

The dimensioning of the discontinuous intermediate layer localised on the metal portions of the chamber can of course be modified according to the structural characteristics of the vacuum bulb and to the different elements that this vacuum bulb comprises, such that no cracks are formed, whether in the overmoulding layer or in the cylindrical body of the chamber, and such that no tearing occurs in the said intermediate layer.

In a variant of the invention, the intermediate layer covers a portion of the outer surface of the cylindrical body of the chamber in addition to covering the outer surface of the metal portions, at least in the area of their edge joined to the dielectric material. The reduction of such thermomechanical stresses therefore substantially reduces or even eliminates, through appropriate dimensioning of the intermediate layer, the risks of cracking in the overmoulding layer and in the cylindrical body of the chamber of the vacuum bulb.

The risks of cracking occurring in the overmoulding layer, but also in the cylindrical body of the chamber of the vacuum bulb, with the related risk of loss of vacuum, are consequently extremely limited, or eliminated with a vacuum bulb in accordance with the invention.

Use of such a discontinuous intermediate layer also enables the costs of manufacture of a vacuum bulb to be limited since it is possible for the particular silicone used to produce this intermediate layer to be localised only on the outer surface of the metal portions of the chamber, since these portions are those which cause the formation of the cracks in the overmoulding layer, particularly when these metal portions of the chamber have protruding portions, i.e. elements protruding from these metal portions.

However, it is perfectly possible to envisage that the intermediate layer can also cover a portion of the outer surface of the sealed chamber, and in particular a portion of the outer surface of the cylindrical body located flush with the outer surface of these metal elements, without however covering the entire outer surface of the sealed chamber, for obvious cost-related reasons.

Such a compressible silicone has been notably described in documents U.S. Pat. No. 5,750,581 and EP 0 971 369, referenced respectively [3] and [4] and the entire respective contents of which are incorporated herein by reference.

In an advantageous variant of the invention, the hollow bodies are microspheres which have, for example, an average diameter of between 1 μm and 800 μm, and advantageously between 10 μm and 80 μm.

The thermoplastic material of the skin of the hollow bodies is chosen such that it enables gas bubbles to be trapped.

Such hollow bodies, or microspheres, are notably available from the company AkzoNobel with the commercial name Expancel®DE. In particular it will be possible to use the microspheres of commercial reference Expancel®920 DET 40 d25.

One compressible silicone of several which are available is notably sold by the company Wacker with the commercial name Elastosil®RT 713.

In a particularly advantageous variant of the invention, the interface between the dielectric coating and the outer surface of the chamber is sealed. There is, consequently, no free space between the outer surface of the chamber and the intermediate layer, between the intermediate layer and the overmoulding layer, and between the outer surface of the chamber which, since it is not in contact with the discontinuous intermediate layer, is in contact with the overmoulding layer.

Such an interface is obtained notably with an excellent adherence between the dielectric coating and the outer surface of the chamber, resulting in there being no residual spaces, between this coating and this outer surface, likely to contain air. Such a sealed interface helps to improve the thermomechanical properties of the vacuum bulb according to the invention.

The vacuum bulb includes a sealed chamber and two electrical contacts which move relative to one another. The sealed chamber of the vacuum bulb, which is maintained at low pressure, includes a cylindrical body made of dielectric material and two metal covers which close this cylindrical body at its ends. The connections between the metal covers and the cylindrical body are advantageously made by welding or brazing. Each of the covers of the chamber is connected to one of the electrical contacts mentioned above. One of the two contacts is preferably stationary while the other one is mobile. The mobility of this electrical contact is provided by a metal bellows which also ensures that the sealed chamber remains tight.

The vacuum bulb can also include at least one protective metal screen positioned inside the sealed chamber and attached to this chamber. The main role of this screen is to protect the inner surface of the cylindrical body from liquid metal vapours and from metallic projections generated by the arc produced between the two electrical contacts when the electrical current is turned off.

This screen can be attached mechanically and electrically to the metal cover to which the stationary electrical contact is connected.

This screen can also be attached mechanically at an intermediate point of the cylindrical body, without any electrical connection with either of the metal covers.

In an advantageous variant of the invention, the cylindrical body includes at least one first portion and one second portion and the protective metal screen is attached to the chamber by attachment means interposed between these first and second portions.

These attachment means can be formed by a shoulder of revolution produced on the said protective metal screen, for example by machining or by pressing. These attachment means can also be formed by a cylindrical metal part, such as a circular ring, where this part is brazed or welded on to the first and second portions of the cylindrical body. Reference can also be made to document EP 1 571 685, reference [5], which describes other means of attachment of such a protective metal screen between the first and second portions of the cylindrical body of the chamber of the vacuum bulb.

Since the means of attachment of the protective metal screen create an area of discontinuity on the outer surface of the cylindrical body of the chamber of the vacuum bulb, the intermediate layer of the coating is also localised on the said attachment means so as to cover at least the entire outer surface of the said attachment means.

Thus, if no metal element of the vacuum bulb (i.e. the covers and, if applicable, the means of attachment of the screen) are in direct contact with the overmoulding layer, the risks of formation of cracks, or fractures, in this overmoulding layer are eliminated.

The cylindrical body of the chamber of the vacuum bulb is made of a dielectric material. The dielectric material is advantageously a ceramic material and, in particular, alumina, this ceramic material being possibly enamelled.

The metal covers of the chamber of the vacuum bulb can be made in particular of copper or stainless steel.

These covers can be shaped such that they have a smooth outer surface, with corners which are blunt or rounded in the direction of the outer surface of the chamber.

These covers can also include one or more elements protruding from these covers, such as shoulders, protruding more or less in the direction of the outer surface of the chamber, where such shoulders are generally considered to constitute edges or areas of fragility which cause cracking in the overmoulding layer. Indeed, since the intermediate layer of the dielectric coating is localised on the metal portions of the chamber so as to cover at least partially the outer surface of these metal portions, and notably of these metal covers, advantageously at least the entire outer surface of the elements protruding from these metal portions and, preferentially, at least the entire outer surface of these metal portions, these protruding portions or shoulders generate no additional risk of cracking. Consequently it is not necessary to add, in the structure of the vacuum bulb according to the invention, protective caps fitted on to the metal cover and protecting the area where they are joined to the cylindrical body, as described in document WO 2009/106731, referenced [6].

The overmoulding layer of the coating of the vacuum bulb according to the invention is, for its part, made of thermosetting polymer, and preferably of epoxide polymer.

The vacuum bulb can also include a shielding layer positioned on the dielectric coating. This shielding layer, which enables the exterior of the vacuum bulb to be earthed, is a layer made of an electrically conductive material according to known methods and devices.

The invention relates, secondly, to a medium-voltage switchgear.

According to the invention, this switchgear includes at least one vacuum bulb as defined above, and notably an overmoulded vacuum bulb, where its advantageous characteristics can be considered individually or in combination. The bulb is connected, through its two electrical contacts, to the electrical connections of the said switchgear.

This switchgear can in particular be a medium-voltage circuit-breaker pole or switch.

The invention relates, thirdly, to a circuit-breaker pole including an assembly formed of a vacuum bulb as defined above, and in particular an overmoulded vacuum bulb, where its advantageous characteristics can be considered individually or in combination, and of two electrically conductive connections, where the said assembly is covered by the overmoulding layer and, if applicable, by the shielding layer.

The invention relates, fourthly, to a method for manufacturing a vacuum bulb as defined above, the advantageous characteristics of which can be considered individually or in combination.

In particular, the invention relates to a method for manufacturing a vacuum bulb including a sealed chamber, two electrical contacts which move relative to one another, and possibly at least one protective metal screen positioned inside the chamber and attached to it, where the said chamber includes a cylindrical body made of a dielectric material and closed at its ends by two metal covers, where each of these covers is connected to one of the electrical contacts, and where the said vacuum bulb also includes a dielectric coating which covers the outer surface of the chamber.

According to the invention this method includes the following successive steps:

(a) assembly of the sealed chamber and of the two electrical contacts, (b) deposition, discontinuous and localised, on the metal portions of the said chamber so as to cover at least partially the outer surface of these metal portions, of a composition of silicone rubber including hollow bodies, where these hollow bodies are compressible and have a skin made of a thermoplastic material, followed by cross-linking of this composition so as to form, on the outer surface of the chamber, the intermediate silicone layer, and (c) injection moulding, notably by means of the automatic pressure gelation method, of the synthetic material, where the synthetic material is an epoxide polymer, so as to form the overmoulding layer, where the intermediate layer and the overmoulding layer form the dielectric coating of the vacuum bulb.

According to one advantageous embodiment of the method of the invention, the silicone rubber composition also includes a cross-linking agent, where the cross-linking of step (b) is obtained by hot vulcanisation, by heating of the said silicone rubber composition.

According to another embodiment of the method of the invention, the cross-linking of step (b) is obtained by cold vulcanisation, by bringing the silicone rubber composition into contact, at ambient temperature, with a cross-linking agent, if applicable in the presence of a catalyst.

Thus, and unlike the current method for manufacturing a vacuum bulb, the method according to the invention does not implement a step of injection moulding of a liquid silicone rubber to produce the intermediate silicone layer. Since production of the intermediate layer does not involve the application of high pressures, which are prejudicial to certain configurations of metal covers of the chamber of the vacuum bulb, the method according to the invention can be envisaged for the manufacture of any type of vacuum bulb, whatever the shape, dimensions and/or metal constituting the covers of the sealed chamber of this vacuum bulb.

The silicone rubber composition can, for example, be deposited by means of a pistol.

This deposition is also localised on the metal portions of the sealed chamber so as to cover at least partially the outer surface of these metal portions.

This deposition is advantageously localised so as to cover at least the entire outer surface of the elements protruding from these metal portions and, preferentially, so as to cover at least the entire outer surface of the said metal portions.

The quantity of the composition of silicone rubber is therefore necessarily smaller than the quantity required to produce a continuous intermediate layer in the current method of manufacturing a vacuum bulb.

It is perfectly possible to envisage, after step (a) and before step (b), applying a primer layer on to the outer surface of the chamber of the vacuum bulb to improve, if required, the adherence of the intermediate layer and/or of the overmoulding layer to this outer surface.

According to one variant, the method for manufacturing a vacuum bulb according to the invention also includes, during step (a), the installation of at least one protective metal screen in the chamber, where this screen is attached to the chamber by attachment means, where step (b) also includes the deposition of the said silicone rubber composition on the attachment means, preferably so as to cover at least the entire outer surface of the said attachment means.

The invention relates, fifthly, to a method for manufacturing a circuit-breaker pole as described above, where this circuit-breaker pole includes an assembly formed of a vacuum bulb as defined above, and the advantageous characteristics of which can be considered individually or in combination, and of two electrically conductive connections, where the said assembly is covered by the overmoulding layer.

According to the invention, this method for manufacturing a circuit-breaker pole includes the following successive steps:

(a) assembly of the vacuum bulb including the sealed chamber and the two electrical contacts, (b) deposition, discontinuous and localised, on the metal portions of the said chamber so as to cover at least partially the outer surface of these metal portions, of a composition of silicone rubber including hollow bodies, where these hollow bodies are compressible and have a skin made of a thermoplastic material, followed by cross-linking of this composition so as to form, on the outer surface of the chamber, the intermediate silicone layer, and (c) injection moulding, notably by means of the automatic pressure gelation method, on the outer surface of the assembly and of the two electrically conductive connections, of the synthetic material, where the synthetic material is an epoxide polymer, so as to form the overmoulding layer, where the method also includes a step of assembly of the vacuum bulb and of the two electrically conductive connections, where this step is implemented either in step (a), or between steps (b) and (c).

As mentioned above in connection with the method for manufacturing a vacuum bulb, according to one advantageous embodiment of the method for manufacturing a circuit-breaker pole according to the invention, the silicone rubber composition also includes a cross-linking agent, where the cross-linking of step (b) is obtained by hot vulcanisation, by heating of the said silicone rubber composition.

According to another embodiment of the method of the invention, the cross-linking of step (b) is obtained by cold vulcanisation, by bringing the silicone rubber composition into contact, at ambient temperature, with a cross-linking agent, if applicable in the presence of a catalyst.

As also mentioned above, the deposition of step (b) is advantageously localised so as to cover at least the entire outer surface of the elements protruding from these metal portions and, preferentially, so as to cover at least the entire outer surface of the said metal portions.

Assembly of the vacuum bulb and of the two electrically conductive connections to form the circuit-breaker pole imposes corners and large changes of section between the different elements constituting this pole, in particular in the area of the electrically conductive connection connected to the stationary electrical contact of the vacuum bulb. And such corners and changes of section can have a direct effect on the thermomechanical properties of the circuit-breaker pole constituted in this manner.

The method for manufacturing a circuit-breaker pole in accordance with the invention enables a circuit-breaker pole to be manufactured the structural constraints of which imposed by its final shape are taken into account.

Production of the overmoulding layer as the final stage, after assembly of the different elements constituting the circuit-breaker pole including the overmoulded vacuum bulb characterised by its particular intermediate, discontinuous and localised layer, made of a silicone including compressible hollow bodies as defined above, enables the thermomechanical constraints caused by the manufacture of the circuit-breaker pole, and the constraints caused by its use, in particular when it is subject to substantial thermal stresses, to be addressed.

According to one variant, the method of manufacture of a circuit-breaker pole according to the invention also includes, during step (a), the installation of at least one protective metal screen in the chamber, where this screen is attached to this chamber by attachment means, where step (b) also includes the deposition of the said silicone rubber composition on the attachment means, preferably so as to cover at least the entire outer surface of the said attachment means.

Other advantages and characteristics of the invention will appear on reading the detailed description which follows and which relates to two switchgears, in this case circuit-breaker poles, one of which includes a vacuum bulb according to the invention.

This detailed description makes also reference to a method for manufacturing an overmoulded vacuum bulb in accordance with the invention.

This description also includes an assessment of the cracking resistance and of the dielectric properties of three overmoulded vacuum bulbs, one of which is in accordance with the invention, before and after thermal stresses.

This detailed description, which refers in particular to FIGS. 1 to 4 as appended, is given as an illustration only, and in no case as a limitation.

BRIEF DESCRIPTION OF THE ILLUSTRATIONS

DETAILED DESCRIPTION OF PARTICULAR EMBODIMENTS

Switchgear

Figure 1:
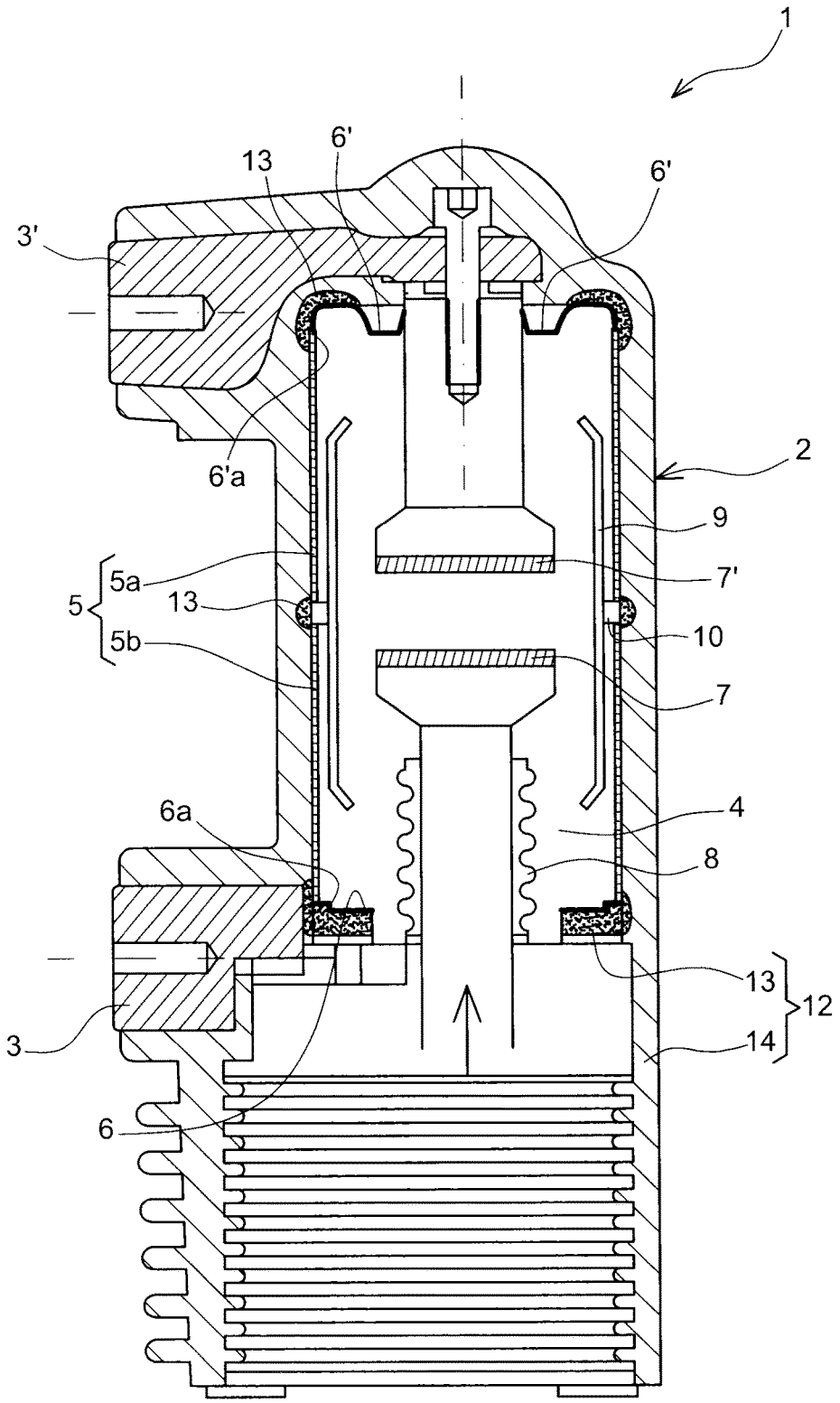
FIG. 1 represents a diagrammatic view as a longitudinal section of a switchgear, in this case a circuit-breaker pole, including a vacuum bulb in accordance with the invention.

In FIG. 1, a circuit-breaker pole 1 has been represented. This circuit-breaker pole 1 is formed by the assembly of a vacuum bulb 2 and of two electrically conductive connections, one lower connection 3 and one upper connection 3'.

Vacuum bulb 2 includes a sealed chamber 4 in which there is a controlled low pressure of air or of another dielectric fluid, also called a "vacuum".

Sealed chamber 4 includes a cylindrical body 5, formed by two portions 5*a* and 5*b* made of a dielectric material, advantageously of a ceramic material, notably of alumina, the ceramic material being possibly enamelled. This material of cylindrical body 5 could also be made of glass.

Cylindrical body 5 is closed at its ends by metal covers 6, 6' which are connected in sealed fashion to cylindrical body 5, for example by brazing or by welding.

Metal covers 6, 6' can have protruding edges 6*a*, 6'*a* extending from their respective outer surfaces.

Chamber 4 also includes two electrical contacts 7, 7' which move relative to one another along the axis of vacuum bulb 1. In a conventional manner, electrical contact 7' is stationary and fixed to metal cover 6', whereas electrical contact 7 moves axially and is connected to metal cover 6. To allow the movement of mobile electrical contact 7 whilst preserving the tightness in sealed chamber 4, a bellows seal 8 is installed.

Sealed chamber 4 also includes a protective metal screen 9 positioned inside sealed chamber 4 and attached to this chamber 4. The function of this protective metal screen 9 is to protect cylindrical body 5 from the liquid metal vapours and from metallic projections from the arc phase produced between electrical contacts 7, 7' when the electrical current is turned off. Protective metal screen 9 is supported by a circular ring 10 attached, for example by brazing, between portions 5*a* and 5*b* of cylindrical body 5.

According to the invention, circuit-breaker pole 1 is covered by a dielectric coating 12 including two layers, an intermediate layer 13 and an overmoulding layer 14 made of a synthetic material. Overmoulding layer 14 is positioned on intermediate layer 13, such that no free space remains between this intermediate layer 13 and this overmoulding layer 14. It is said that the interface between dielectric coating 12 and the outer surface of chamber 4 is sealed.

Intermediate layer 13 is a discontinuous layer localised on the metal portions of sealed chamber 4 so as to cover at least partially the outer surface of these metal portions. At least the protruding portions of the metal portions are advantageously fully covered, together with the edges of the said metal portions joined to the dielectric material of cylindrical body 5.

In FIG. 1, intermediate layer 13 covers at least partially the outer surface of metal portions 6, 6' and 10. Intermediate layer 13 is thus localised on the outer surface of metal covers 6, 6' and on the outer surface of circular ring 10 of protective metal screen 9, i.e. on the surfaces or areas of overmoulding layer 14 which are sensitive to cracking.

Indeed, since the metal outer surfaces of sealed chamber 4, and in particular those of protruding portions 6*a*, 6'*a* of metal covers 6, 6', are covered by intermediate layer 13, they are no longer in direct contact with overmoulding layer 14. The risks of cracking of overmoulding layer 14 by these outer metal surfaces, including those of protruding portions 6*a*, 6'*a*, are consequently eliminated.

It is also important to note that this intermediate layer 13 is made of a particular silicone. Indeed, this silicone includes hollow bodies which are compressible, and which include a skin made of a thermoplastic material.

Use of such a silicone, which can be qualified as "compressible", therefore enables a dielectric coating 12 to be formed, the intermediate layer 13 of which can absorb the thermal expansion variations between the metal elements (covers 6, 6' and circular ring 10) of sealed chamber 4 and overmoulding layer 14, without any expansion of the volume which this intermediate layer 13 occupies within dielectric coating 12. Indeed, the expansion of intermediate layer 13 is in some sense "absorbed" by the hollow bodies present in the silicone. Consequently, under the effect of the thermal stresses to which circuit-breaker pole 1 can be subject, no formation of cracks in overmoulding layer 14 is observed.

Conversely, use of a silicone which is non-compressible in nature, as described in documents [1] and [2], in such an intermediate dielectric coating layer does not enable the risk of cracking to be eliminated in the overmoulding layer of such a coating. Indeed, under the effect of the same thermal stresses, when the intermediate layer expands it causes thermomechanical stresses not only on the overmoulding layer, but also on the cylindrical body, causing a double risk of cracking, or of fracture, of the overmoulding layer and of the ceramic material of the sealed chamber, with the inherent loss of vacuum.

Dielectric coating 12 can itself be covered by an electrically conductive layer, called a "shielding layer" (not illustrated).

Method for Manufacturing a Vacuum Bulb in Accordance with the Invention

A method for manufacturing a vacuum bulb will now be described, where this method is in accordance with the invention.

A pre-assembled vacuum bulb is used, of reference Schneider Electric VG3-I, which is commercially available.

Such a vacuum bulb includes a sealed chamber, two electrical contacts and a protective metal screen, but has no dielectric coating. The sealed chamber of this vacuum bulb is formed from a cylindrical body including two portions made of ceramic material, and closed by two metal covers with protruding edges. The sealed chamber also includes a cylindrical metal ring connected with the two portions made of ceramic material, where this ring constitutes the bracket of the protective metal screen.

After a possible prior cleaning of the vacuum bulb, for example using isopropanol, in order to eliminate every residual trace of foreign bodies (greasy substances, dust, etc.), beads or strips of a silicone rubber called "high compressibility silicone rubber", sold by the company Wacker with the commercial name Elastosil®RT 713, are deposited on the outer surface of the metal covers of the chamber and on the outer surface of the cylindrical metal ring constituting the bracket of the protective metal screen. This deposition is accomplished such that the entire outer surface of the metal covers, together with the entire outer surface of the cylindrical metal ring, are covered by the silicone rubber. These silicone beads have the form of a truncated toroid, the radius of which is greater than or equal to 3 mm.

Such a deposition on the metal surfaces of the sealed chamber enables all the metal areas or portions of the outer surface of this sealed chamber to be covered, and by so doing, enables the coating of any protruding edges of the metal covers, and also of the "triple point" of the ceramic material, where the triple point is the joining area between the two portions made of ceramic material of the cylindrical body and the cylindrical metal ring.

It is perfectly possible to envisage that the metal portions could be only partially covered by the intermediate layer. In particular, there is no imperative requirement for the metal areas or portions without protruding corners to be coated.

Through such a localised deposition, are prevented any incipient rupture which might be caused, in the overmoulding layer, by the stresses exerted by the metal elements of the chamber, and notably by any protruding edges of the covers, if these metal elements were overmoulded directly with an epoxide polymer, or if a non-compressible silicone were used.

The deposition can advantageously be accomplished such that the areas or portions of the outer surface of the cylindrical body adjoining these metal surfaces formed by metal covers and by the metal cylindrical ring are also covered by this silicone rubber. Although such a hypothesis is conceivable, there is however no advantage in depositing a continuous intermediate layer on the entire outer surface of the cylindrical body, notably for economic reasons.

The vacuum bulb coated with beads of silicone rubber is then cleaned once again, for example using isopropanol, to eliminate the foreign bodies, and by this means to improve the subsequent adherence of the overmoulding layer. It is then placed in a furnace at a temperature of between 160° C. and 170° for 2 hours, to allow the cross-linking of the silicone rubber.

After it is removed from the furnace, the vacuum bulb coated with silicone beads or strips is placed in a mould which is then closed, and the temperature of which is raised to and then maintained at 150° C. throughout the moulding cycle; the mould dimensions are such that filling the space remaining between the vacuum bulb and the mould with the chosen material enables a compact overmoulding layer to be obtained, of the desired thickness.

Injection moulding is then undertaken, preferably using automatic pressure gelation, to form the overmoulding layer.

To accomplish this, a blend including epoxide monomers, a hardening agent and a mineral filler, which blend is sold by the company Huntsman, with the commercial name Araldite®CY 225/HY 225 (hardening agent)/silica flour, and in which the compounds are in the respective proportions by weight of 100/80/270, is injected at an injection pressure of between approximately 1 bar and 1.5 bar. A pressure called a "gelation" pressure of 6 bar maximum is then applied for a cycle time of 22 min., before the mould is opened and the vacuum bulb is extracted. Post-curing of the overmoulded vacuum bulb including the chamber, the electrical contacts and the dielectric coating formed of the intermediate layer and of the overmoulding layer is accomplished by heating the mould at 145° C. for 220 min., and then at 130° C. for 44 min., and then finally at 80° C. for 44 min.

Assessment of the Cracking Resistance and of the Dielectric Properties of Vacuum Bulbs before and after Thermal Stresses The tests which were undertaken are intended to assess the cracking resistance of the overmoulding layer and of the sealed chamber of three vacuum bulbs, one of which is in accordance with the invention, together with the dielectric properties of these vacuum bulbs before and after accomplishment of various thermal cycles.

To assess the cracking resistance of the overmoulding layer made of an epoxide polymer, and of the sealed chamber of these three vacuum bulbs, previously assembled vacuum bulbs were used, of reference Schneider Electric VG2, which are available commercially.

These vacuum bulbs have two metal covers, on which were deposited, in succession, a discontinuous intermediate layer localised according to the characteristics of the invention, followed by an identical overmoulding layer made of epoxide polymer. Although for these three vacuum bulbs the overmoulding layer is identical both in terms of composition and of thickness, the intermediate layer of the same thickness, for its part, was made from three different silicones.

The materials used to produce the intermediate and overmoulding layers are as follows:

Intermediate Layer

- compressible silicone of reference Elastosil®RT 713 from the company Wacker, having the reference Silicone-1 in the tables below, for production of a vacuum bulb in accordance with the invention,
- non-compressible silicone of reference Rhodorsil®RTV 3428 from the company Rhodia, a silicone having the reference Silicone-2 in the tables below, for production of a vacuum bulb according to the prior art,
- non-compressible silicone of reference Silicomet®AS 310 from the company Henkel, a silicone having the reference Silicone-3 in the tables below, for production of a vacuum bulb according to the prior art.

Overmoulding Layer

The blend formed of 100 pp of Araldite®CY 5824-CI resin sold by the company Huntsman Advanced Materials, of 80 pp of hardening agent Aradur®HY 5924-CI, also sold by the company Huntsman Advanced Materials, and of 300 pp of Silbond®W12EST silica, sold by the company Quartzwerke Gruppe, was used.

The measurements made and the associated settings, where these parameters are defined in an IEC standard, are as follows:

- a voltage of 44 kV is applied for 60 s at a frequency of 50 Hz, which corresponds to the value called the "Power Frequency Withstand" value, noted "PFW" in tables 3 to 5 below;
- the partial discharge level is measured, noted "PD" in tables 3 to 5 below, at 20 kVrms at the time of the 44 kV descent: the values obtained in pC (pico Coulombs) are shown in table 1; and
- the distance between the earthed metal plate and the axis of the poles is 110 mm.

Various thermal cycles were undertaken. The variations of temperature (T) as a function of time (t) applied at the rate of 2° C. per minute are given in tables 1 and 2 below and illustrated in FIGS. 2 and 3, respectively, where the ambient temperature (Tamb) is also stipulated in these figures.

TABLE 1

| Hot cycles | Duration (h) | Observations |
|---|---|---|
| Cycle at 50° C. | 8 | OK |
| Cycle at 70° C. | 16 | OK |
| Cycle at 90° C. | 8 | OK |
| Cycle at 110° C. | 16 | OK |

Figure 2:
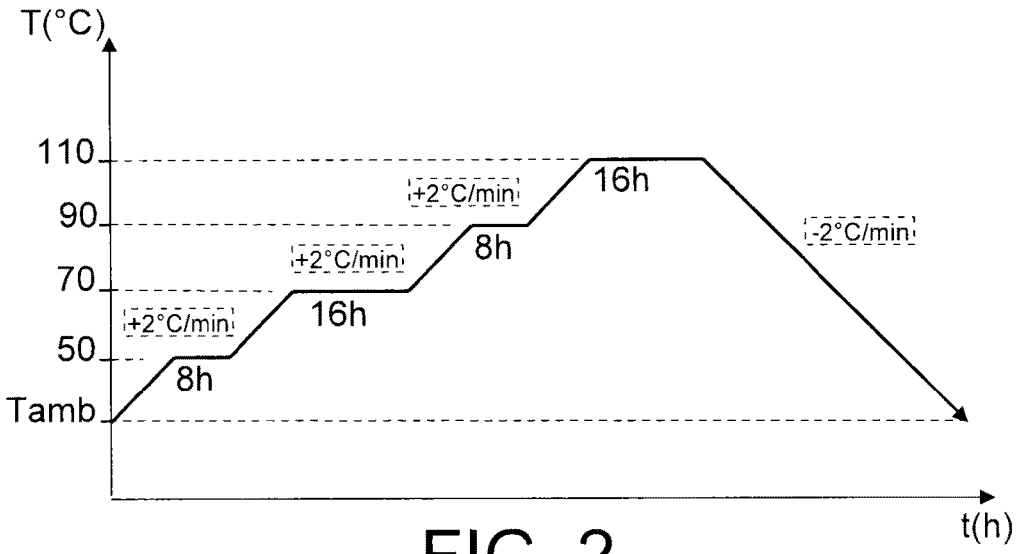
FIG. 2 illustrates the hot thermal cycles to which the vacuum bulbs which were assessed were subjected.

In the column "Observations", the expression "OK" means that none of the tested vacuum bulbs was degraded under the effect of the thermal cycles called "hot" thermal cycles, corresponding to rises in surrounding temperature, in accordance with table 1 above, and illustrated in FIG. 2.

TABLE 2

| Cold cycles | Duration (h) | Observations |
|---|---|---|
| Cycle at −10° C. | 8 | OK except for Silicone-3 |
| Cycle at −20° C. | 16 | OK |
| Cycle at −30° C. | 8 | OK |
| Cycle at −40° C. | 16 | OK |

Figure 3:
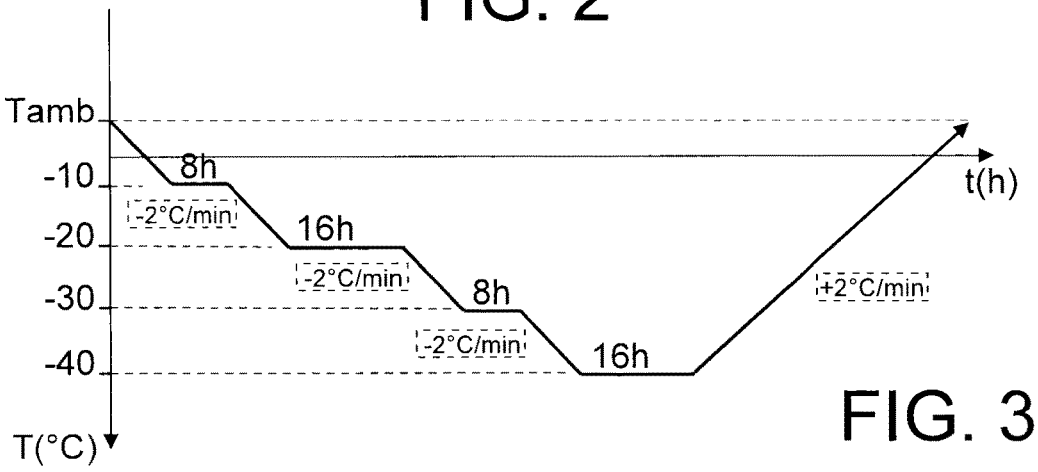
FIG. 3 illustrates the cold thermal cycles to which the vacuum bulbs which were assessed were subjected.

It is observed that, except for the vacuum bulb the intermediate layer of which is produced with Silicone-3, which cracked during the first cycle at −10° C., the vacuum bulbs including Silicone-1 and Silicone-2 did not degrade under the effect of the "cold" thermal cycles, corresponding to drops in surrounding temperature, in accordance with table 2 above, and illustrated in FIG. 3.

Figure 4:
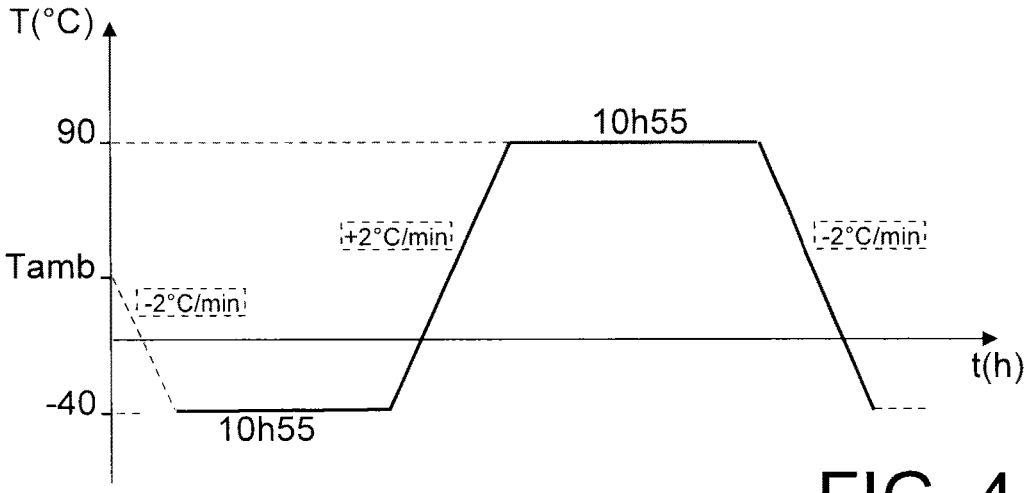
FIG. 4 illustrates the alternative thermal cycles to which the vacuum bulbs which were assessed were subjected.

"Alternative" thermal cycles were also undertaken. Temperature variations between −40° C. and 90° C. are illustrated in FIG. 4.

It is noted that, on conclusion of 4 successive alternative cycles, the vacuum bulb the intermediate layer of which is produced with Silicone-2 has cracks, which is not the case with the vacuum bulb according to the invention, which has an intermediate layer of Silicone-1.

The PFW (power frequency withstand), SA (ignition threshold), SE (extinction threshold) and PD (partial discharge) measurements taken, before application of the different thermal cycles, are shown in table 3 below, the measuring conditions being as follows: temperature 23.6° C., pressure 1024 mbar and relative humidity 32.7%:

TABLE 3

| | Position of the electrical contacts | | | | | |
|---|---|---|---|---|---|---|
| | Open position Voltage applied to the stationary electrical contact | | Open position Voltage applied to the mobile electrical contact | | Closed position | |
| Silicone | PFW, SA, SE | PD (pC) | PFW, SA, SE | PD (pC) | PFW, SA, SE | PD (pC) |
| Silicone-1 (according to the invention) | PFW: OK<br>SA > 44 kVrms<br>SE > 44 kVrms | <5 | PFW: OK<br>SA > 44 kVrms<br>SE > 44 kVrms | <5 | PFW: OK<br>SA = 28 kVrms<br>SE = 22 kVrms | <5 |
| Silicone-2 (according to the state of the art) | PFW: OK<br>SA > 44 kVrms<br>SE > 44 kVrms | <5 | PFW: OK<br>SA > 44 kVrms<br>SE > 44 kVrms | <5 | PFW: OK<br>SA = 29 kVrms<br>SE = 29 kVrms | <5 |
| Silicone-3 (according to the state of the art) | PFW: OK<br>SA = 39 kVrms<br>SE = 36 kVrms | <5 | PFW: not OK(*)<br>SA = 41 kVrms<br>SE = 29 kVrms | <5 | PFW: OK<br>SA = 30 kVrms<br>SE = 26 kVrms | <5 |

(*)In this position the PFW measurement for the vacuum bulb including the intermediate layer made of Silicone-3 can be 41 kVrms maximum. Above this value initiation occurs in the vacuum bulb which does not impair the electrical insulation of the overmoulding layer.

The PFW, SA, SE and PD measurements made, after application of the hot and then cold thermal cycles according to the profile represented in FIGS. 2 and 3, i.e. 8 h at 50° C., 16 h at 70° C., 8 h at 90° C., 16 h at 110° C., and then 8 h at −10° C., 16 h at −20° C., 8 h at −30° C., 16 h at −40° C., are shown in table 4 below, the measuring conditions being as follows: temperature 22.6° C., pressure 999.6 mbar and relative humidity 31.9%:

TABLE 4

| | Position of the electrical contacts | | | | | |
|---|---|---|---|---|---|---|
| | Open position Voltage applied to the stationary electrical contact | | Open position Voltage applied to the mobile electrical contact | | Closed position | |
| Silicone | PFW, SA, SE | PD (pC) | PFW, SA, SE | PD (pC) | PFW, SA, SE | PD (pC) |
| Silicone-1 (according to the invention) | PFW: OK<br>SA > 44 kVrms<br>SE > 44 kVrms | <5 | PFW: OK<br>SA > 44 kVrms<br>SE > 44 kVrms | <5 | PFW: OK<br>SA = 23 kVrms<br>SE = 23 kVrms | <5 |
| Silicone-2 (according to the state of the art) | PFW: OK<br>SA > 44 kVrms<br>SE > 44 kVrms | <5 | PFW: OK<br>SA > 44 kVrms<br>SE > 44 kVrms | <5 | PFW: OK<br>SA = 25 kVrms<br>SE = 20 kVrms | <5 |
| Silicone-3 (according to the state of the art) | | | Cracked vacuum bulb | | | |

It is observed that only the vacuum bulbs including the intermediate layer made of Silicone-1 and Silicone-2 resisted cracking, and had satisfactory dielectric properties after the hot and then cold thermal cycles.

The PFW, SA, SE and PD measurements made, after application of the alternative thermal cycles according to the profile represented in FIG. 4, are shown in table 5 below, the measuring conditions being as follows: temperature 23.7° C., pressure 1019.2 mbar and relative humidity 35.8%:

TABLE 5

| | Position of the electrical contacts | | | | | |
|---|---|---|---|---|---|---|
| | Open position Voltage applied to the stationary electrical contact | | Open position Voltage applied to the mobile electrical contact | | Closed position | |
| Silicone | PFW, SA, SE | PD (pC) | PFW, SA, SE | PD (pC) | PFW, SA, SE | PD (pC) |
| Silicone-1 (according to the invention) | PFW: OK<br>SA > 44 kVrms<br>SE > 44 kVrms | <5 | PFW: OK<br>SA > 44 kVrms<br>SE > 44 kVrms | <5 | PFW: OK<br>SA = 28 kVrms<br>SE = 24 kVrms | <5 |
| Silicone-2 (according to the state of the art) | | | Cracked vacuum bulb | | | |
| Silicone-3 (according to the state of the art) | | | Cracked vacuum bulb | | | |

It is observed that only the vacuum bulb in accordance with the invention including the intermediate layer made of Silicone-1 resisted cracking, and had satisfactory dielectric properties after the alternative thermal cycles.

BIBLIOGRAPHY

[1] EP 0 866 481 A2
[2] U.S. Pat. No. 5,917,167
[3] U.S. Pat. No. 5,750,581
[4] EP 0 971 369 A1
[5] EP 1 571 685 A1
[6] WO 2009/106731 A2

The invention claimed is:

1. A vacuum bulb, comprising:
a sealed chamber;
two electrical contacts, which move relative to one another,
wherein the sealed chamber includes a cylindrical body made of a dielectric material and closed at ends thereof by two metal covers,
wherein each of the two metal covers is connected to one of the two electrical contacts; and
a dielectric coating, which covers an outer surface of the sealed chamber,
wherein the dielectric coating includes at least two layers, including an overmoulding layer made of a synthetic material and an intermediate layer made of silicone,
wherein the intermediate layer is interposed between the outer surface of the sealed chamber and the overmoulding layer,
wherein the intermediate layer is discontinuous and localised in direct contact with at least a portion of each of the two metal covers, so as to cover at least partially an outer surface of the two metal covers, and
wherein the silicone of the intermediate layer includes hollow bodies that are compressible and have a skin made of a thermoplastic material.

2. The vacuum bulb according to claim 1, wherein the hollow bodies are microspheres having an average diameter of between 1 μm and 800 μm.

3. The vacuum bulb according to claim 1, wherein an interface between the dielectric coating and the outer surface of the sealed chamber is sealed.

4. The vacuum bulb according to claim 1, further comprising at least one protective metal screen positioned inside the sealed chamber and attached to the sealed chamber.

5. The vacuum bulb according to claim 4, wherein the cylindrical body includes at least one first portion and one second portion, the protective metal screen is attached to the sealed chamber by an attachment means interposed between the at least one first portion and one second portion, and the intermediate layer is also localised on the attachment means so as to cover at least an entire outer surface of the attachment means.

6. The vacuum bulb according to claim 1, wherein the cylindrical body is made of a ceramic material.

7. The vacuum bulb according to claim 6, wherein the ceramic material is alumina.

8. The vacuum bulb according to claim 7, wherein the ceramic material is enameled.

9. The vacuum bulb according to claim 1, wherein the overmoulding layer is made of a thermosetting polymer.

10. The vacuum bulb according to claim 1, further comprising a shielding layer positioned on the dielectric coating.

11. A medium-voltage switchgear including at least one vacuum bulb according to claim 1.

12. A circuit-breaker pole including an assembly formed of a vacuum bulb according to claim 1 and of two electrically conductive connections, wherein the assembly is coated by the overmoulding layer.

13. The circuit-breaker pole according to claim 12, wherein the overmoulding layer is coated by a shielding layer positioned on the dielectric coating.

14. The vacuum bulb according to claim 1, wherein the hollow bodies are microspheres having an average diameter of between 10 μm and 80 μm.

15. The vacuum bulb according to claim 1, wherein the overmoulding layer is made of an epoxide polymer.

16. The vacuum bulb according to claim 1, wherein the two metal covers are provided with elements protruding from the two metal covers and the intermediate layer is localised in direct contact with at least a portion of each of the two metal covers so as to cover at least entirely an outer surface of the elements.

17. The vacuum bulb according to claim 1, wherein the intermediate layer is localised in direct contact with at least a portion of each of the two metal covers so as to cover at least entirely the outer surface of the two metal covers.

18. The vacuum bulb according to claim 1, wherein the intermediate layer is also localised in direct contact with portions of the cylindrical body, at least in an area of an edge of each of the two metal covers that is joined to the dielectric material of the cylindrical body.

* * * * *